US008991511B2

(12) United States Patent
Fabre et al.

(10) Patent No.: US 8,991,511 B2
(45) Date of Patent: Mar. 31, 2015

(54) FLUID EJECTION DEVICE

(75) Inventors: Christian Fabre, Tournefeuille (FR); Alain Bignolais, Leguevin (FR)

(73) Assignee: Airbus Operations S.A.S, Toulouse (FR)

( * ) Notice: Subject to any disclaimer, the term of this patent is extended or adjusted under 35 U.S.C. 154(b) by 369 days.

(21) Appl. No.: 13/513,735

(22) PCT Filed: Dec. 3, 2010

(86) PCT No.: PCT/FR2010/052608

§ 371 (c)(1),
(2), (4) Date: Jul. 23, 2012

(87) PCT Pub. No.: WO2011/067546

PCT Pub. Date: Jun. 9, 2011

(65) Prior Publication Data

US 2012/0279729 A1 Nov. 8, 2012

(30) Foreign Application Priority Data

Dec. 4, 2009 (FR) ..... 09 58676

(51) Int. Cl.

| | |
|---|---|
| ***A62C 11/00*** | (2006.01) |
| ***A62C 13/66*** | (2006.01) |
| ***A62C 35/02*** | (2006.01) |
| *A62C 13/00* | (2006.01) |

(52) U.S. Cl.

CPC ..... *A62C 13/66* (2013.01); *A62C 35/02* (2013.01); *A62C 13/006* (2013.01)

USPC ..... 169/33; 169/71; 169/84; 169/9

(58) Field of Classification Search

CPC .... A62C 35/023; A62C 13/66; A62C 13/006; A62C 35/02

USPC ..... 222/41–50; 169/9, 71, 6, 11, 72, 84, 85, 169/81, 73, 83; 239/73

See application file for complete search history.

(56) References Cited

U.S. PATENT DOCUMENTS

| | | | | |
|---|---|---|---|---|
| 6,502,828 | B1 | 1/2003 | Sasaki | |
| 8,783,372 | B2 * | 7/2014 | Fabre et al. | 169/9 |
| 2010/0230118 | A1 | 9/2010 | Fabre et al. | |

FOREIGN PATENT DOCUMENTS

| | | |
|---|---|---|
| DE | 199 49 588 | 5/2000 |
| FR | 2 922 972 | 5/2009 |
| WO | 2009 056574 | 5/2009 |
| WO | WO 2009056574 A1 * | 5/2009 |

OTHER PUBLICATIONS

International Search Report Issued Mar. 7, 2011 in PCT/FR10/52608 Filed Dec. 3, 2010.

* cited by examiner

*Primary Examiner* — Jason Boeckmann

(74) *Attorney, Agent, or Firm* — Oblon, McClelland, Maier & Neustadt, L.L.P.

(57) ABSTRACT

A fluid ejection device for example used as a fire extinguisher in which ejected fluid is an extinguishing agent in liquid or powdery form. The device includes: a cylinder shaped tank, split hermetically, perpendicular to its axis, into two chambers by a piston, slidable axially inside the tank; a first chamber, including a non-gaseous fluid, which communicates with an ejection port closed by a cap, which can open for a pressure greater than or equal to a defined pressure in the first chamber; a second pressurization chamber to be connected to a mechanism increasing pressure in the chamber; and a mechanism to link the piston to the tank in full fixity at a storage position, which mechanism can break and release the piston for axial translation at a pressure higher than or equal to a given pressure in the pressurization chamber, to cause the fluid to be ejected.

10 Claims, 2 Drawing Sheets

Detail Z

FLUID EJECTION DEVICE

The invention belongs to the field of fluid ejection devices. Such devices are more specifically used as fire extinguishers, where the ejected fluid is an extinguishing agent in liquid or powdery form.

Such devices are described, for example, in international patent application WO2009056574, in the applicant's name.

According to the prior state of the art, such devices comprise:

- a cylinder-shaped tank, split into two sealed chambers by an axially mobile piston;
- a first chamber contains the fluid to be ejected; it communicates with an ejection port, closed by a cap;
- a second chamber, called "pressurization chamber", is connected to means of increasing the pressure in said chamber.

To trigger the device and cause the liquid contained in the first chamber to be ejected, the pressure is increased in the pressurization chamber, either by making this last communicate with a pressurized fluid or by activating a pyrotechnic gas generator within it. The increased pressure causes the translation of the piston from the second chamber towards the first, thus increasing the pressure in this first chamber. The ejection port closing cap breaks at a given pressure, opening the passage and causing the fluid to be ejected from the first chamber.

This device of the prior state of the art has the advantage that it is subjected to no pressure, except during the fluid ejection phase. Since it is not stressed, it can remain in this passive mode for years; in this way it is often used as a fire safety device. Since the piston that makes the separation between the two chambers is free to move in translation, the fluid contained in the first, hermetic, chamber is free to dilate or contract in step with the temperature during this passive phase; this causes the piston to move in translation during these changes in volume. Thus, the first chamber is always filled with a quasi-pure fluid, which improves the effectiveness of fire-fighting during the ejection phase when the liquid is, for example, an extinguishing agent.

However, these movements of the piston, due to the changes in the volume of the fluid contained in the first chamber, cause wear in elements such as the seals and membranes that provide the hermeticity between the two chambers. This effect is more specifically pronounced when the fluid contained in the first chamber has a high coefficient of thermal expansion, as is the case for fluoroketones used in fire-fighting and when the fluid ejection device is subjected to large temperature amplitude variations, as is the case in fire-fighting devices for aircraft engine fires.

This wear of the sealing elements can have a negative effect on the reliability of the device.

To solve this shortcoming in the previous state of the art, the invention proposes a fluid ejection device that comprises:

- a cylinder shaped tank, split hermetically, perpendicular to its axis, into two chambers by an element called "piston", which is able to slide axially inside the tank;
- a first chamber, containing a non-gaseous fluid, which communicates with an ejection port closed by a cap, designed to open at a pressure greater than or equal to a defined pressure in said first chamber;
- a second chamber, called "pressurization chamber", designed to be connected to means of increasing the pressure in said chamber;
- means that link the piston to the reservoir in full fixity, designed to break and release the piston for axial translation at a pressure greater than or equal to a defined pressure in the pressurization chamber.

Thus, the piston is immobile in relation to the tank except for the fluid ejection phase. Because of this, the sealing elements are not subjected to mechanical wear or to continuous friction against the body of the tank. The tank can thus be manufactured with a lesser internal surface finish quality and therefore at lower cost, without degrading the reliability of the device.

Advantageously, the means that link the piston to the tank are designed to break when subjected to increased pressure in the pressurization chamber and cannot be separated in case of increased pressure in the chamber that contains the fluid to be ejected. Thus, the piston can only be released during a fluid ejection phase and cannot be separated from the body by overpressure in the chamber that contains the fluid to be ejected.

According to an advantageous embodiment, the piston comprises means able to immobilize it for translation, relative to the tank, in a direction going from the first towards the second chamber with an end position corresponding to the position called "drainage position". Thus, after the fluid has been ejected and the first chamber of the tank emptied, the piston thus immobilized in translation prevents any fluid from returning into the tank. In particular, with this arrangement, several devices of this type, which can be triggered sequentially, can be coupled in parallel in a single fluid distribution circuit.

Advantageously, the piston comprises:

- two rings making a seal with the inner surface of the tank; said rings are separated and arranged axially so as to form an annular chamber between the piston and the inner surface of the tank;
- communication ports between said annular chamber and the pressurization chamber;
- means of closing said ports designed to open when subjected to a defined pressure in the pressurization chamber.

According to this embodiment, the device also comprises means of placing the annular chamber of the piston in communication with the chamber that contains the fluid when the piston is in a drainage axial position.

Thus, the gas leaves the pressurization chamber through the piston ports and the drainage port when the piston gets to the end of the stroke; this has the effect of depressurizing the pressurization chamber and of purging the fluid distribution circuit.

Advantageously, the means of closing the communication ports between the annular chamber of the piston and the pressurization chamber consist of an expanding elastic ring, so as to open the communication ports when subjected to the pressure in the pressurization chamber. Thus, when the pressure decreases in the pressurization chamber, the ring tightens over the piston's ports by springback effect, closing the pressurization chamber hermetically and preventing any fluid from returning into the tank. This arrangement is particularly advantageous when several devices of this type, which can be triggered sequentially, are mounted on a single fluid distribution circuit.

Advantageously, the device comprises a cap that closes the chamber comprising the fluid to be ejected and that is detachable at a defined pressure. Since the piston is fixed in the passive phase, variations in volume in the first chamber cannot be compensated for by displacement of the piston. To achieve this, the first chamber is only partially filled with the fluid and the residual volume is advantageously filled with a compressible inert gas such as argon, nitrogen or helium. The detachable cap has a safety role in case of overpressure in the first chamber by opening it to the outside above a defined pressure, avoiding any risk of the tank exploding.

The invention will now be described more precisely in the context of preferred non-limiting embodiments shown in FIGS. 1 to 3 in which.

Figure 3:
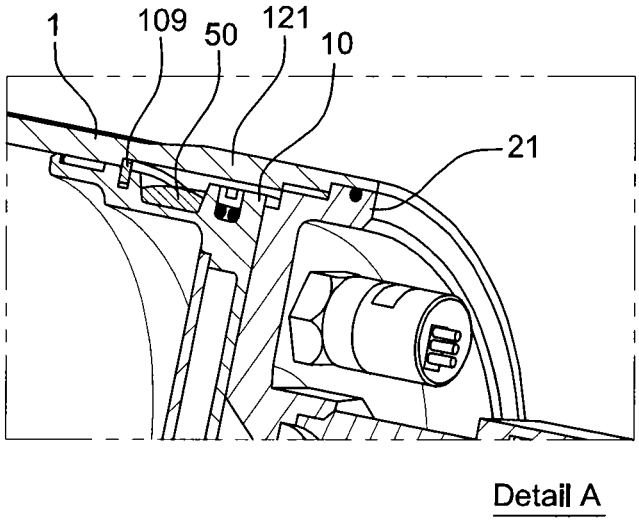

and FIG. 3 represents a detail cross-section view in perspective of the piston in the drainage axial position.

Figure 1:
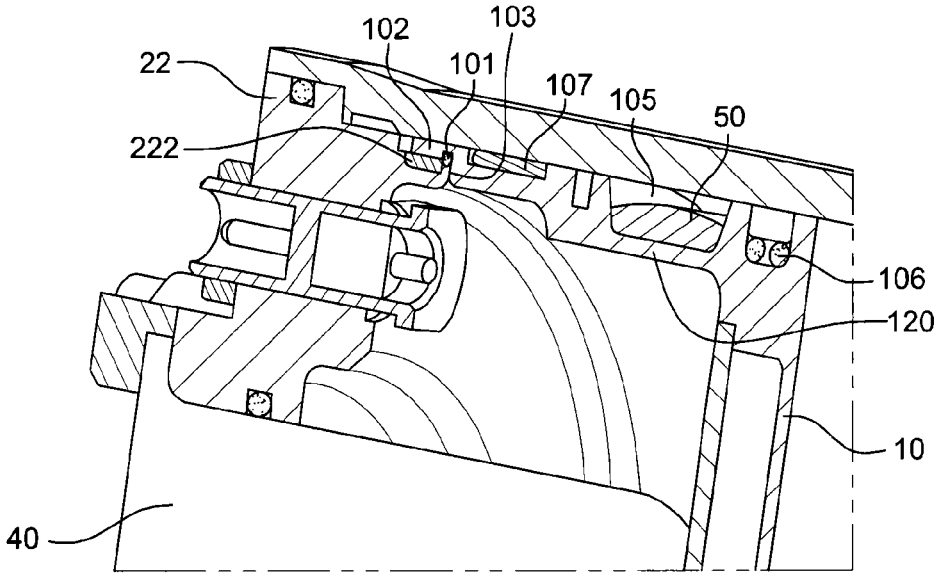
FIG. 1 represents a longitudinal cross-section view in perspective of an example of realization of the device according to the invention in the passive phase.
Figure 1:
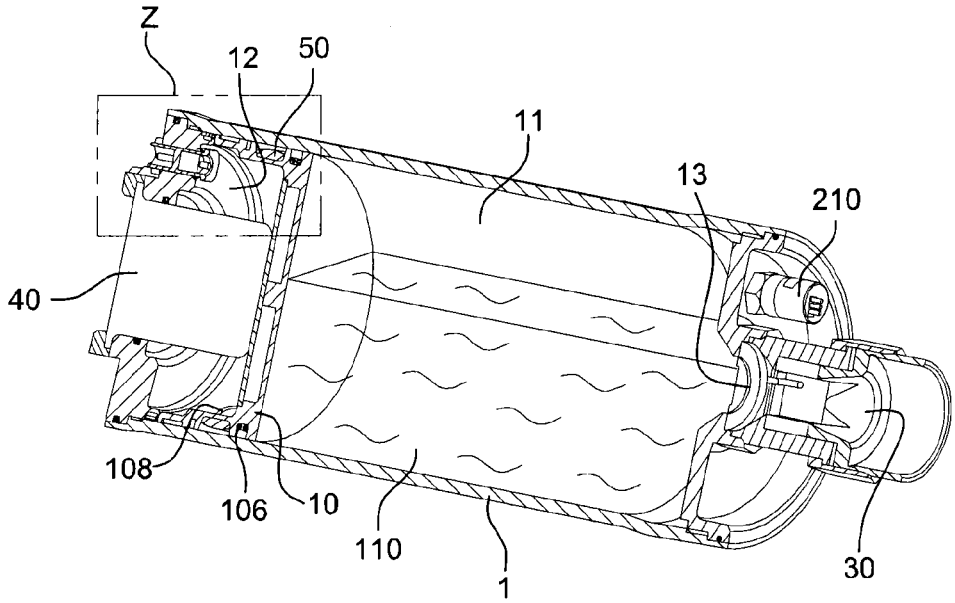

FIG. 1: according to an example of realization, the fluid ejection device that is the subject of the invention comprises a cylinder-shaped body (1), split into two chambers (11,12) by a piston (10) and closed at its extremities by two flanges (21, 22). The first chamber (11) is partially filled with the fluid to be ejected (110); the remainder of the volume is filled with an inert gas such that the pressure inside the chamber is always higher than the atmospheric pressure. This first chamber communicates with a port (13) made in the extremity flange (21), which port is closed by a detachable cap (30). The hermeticity of the first chamber can be checked with means of measuring (210) the pressure therein. The second chamber (12), called "pressurization chamber", is also closed by a flange (22), which also supports means (40), in this case a pyrotechnic gas generator (40), designed to increase the pressure in this chamber.

FIG. 1 detail Z: the extremity (102) of the piston's skirt (120) comprises an inside threading and a shoulder (103) with a diameter smaller than the diameter of the threaded portion. Said threaded portion is screwed on a threaded portion (222) of the flange (22) that extends from the pressurization chamber until the shoulder (103) of the skirt comes into contact with said flange. The piston's skirt has a reduction in thickness (101) between the shoulder and the inside threading (102). When the pyrotechnic reaction is triggered in the gas generator (40), the pressure increases in the pressurization chamber (12) and the flow of force applied to the piston (10) goes through this reduced-section area (101) which is then subjected to traction. Beyond a critical force defined by the thickness of this area, this last breaks and releases the piston (10). On the contrary, if the pressure increases in the fluid (110) contained in the first chamber (11), the flow of force to which the piston (10) is subjected goes via the shoulder (103) and is transmitted to the flange (22) without going through the reduced section (101) area which is not used.

The piston comprises means of creating a seal (106, 107) with the interior of the tank, which define an annular chamber (105) between a groove made in the skirt of the piston and the inner wall of the tank. Exit ports (108) go through the bottom of said groove, making the pressurization chamber (12) communicate with the annular chamber (105). When there is no pressure in the pressurization chamber, these ports are closed by an elastic ring (50). When the pressure increases in the pressurization chamber (12), the radial expansion of the elastic ring subjected to the pressure makes the gas contained in the pressurization chamber (12) come in communication with the annular chamber (105).

Figure 2:
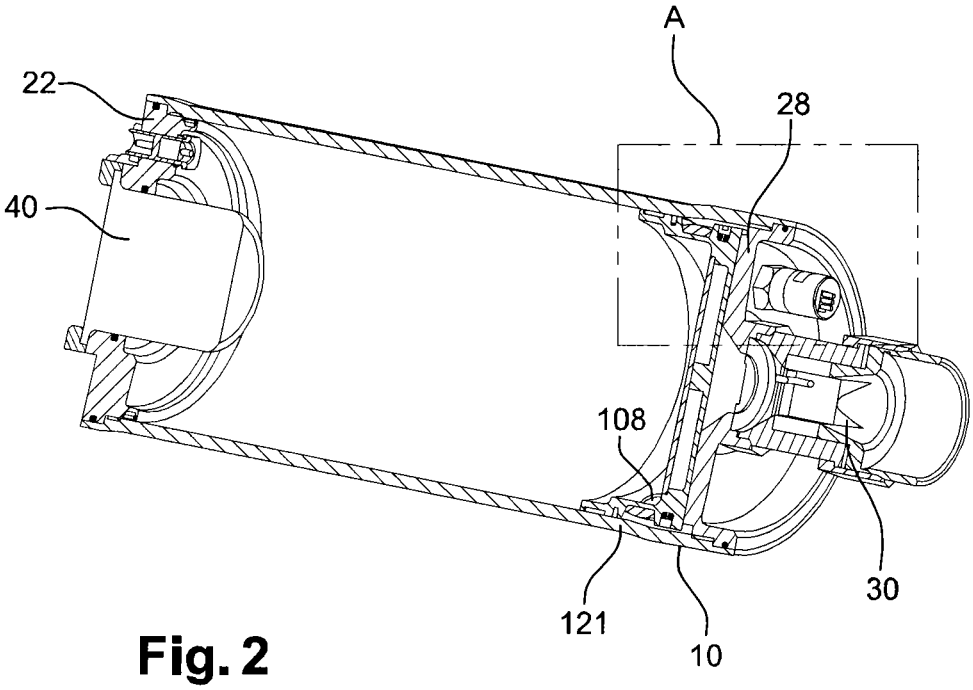
FIG. 2 is a longitudinal cross-section view in perspective of the device according to an example of realization, after said device has been triggered when the piston reaches the axial position called "drainage"

FIG. 2: the reduced section (101) of the piston breaks under the effect of the increased pressure in the pressurization chamber (12) caused by triggering the pyrotechnic reaction in the gas generator (40); this releases the piston, which by translating axially in the tank, causes the pressure in the fluid (110) contained in the first chamber (11) to increase. When the pressure reaches a given threshold, the detachable cap (30) breaks in turn, opening up the port (13) of the extremity flange (22) and allows the fluid (110) to be ejected through this port. The piston continues its translation under the effect of the gas pressure, thus flushing all the fluid (110) contained in the tank. Beyond an axial position of the piston, called "drainage position", the internal diameter of the tank increases to form a shoulder (121). This increase in diameter breaks the seal between the seal (106) located at the front of the annular chamber (105) such that, because the ports (108) in the piston's skirt are open as the elastic ring (50) is still expanded by the gas pressure, said gas is in communication with the port (13). The pressurization chamber is thus purged and if the port (13) is open to a fluid distribution circuit (110), said circuit is also purged. As the gas escapes, the pressure in the pressurization chamber decreases and the elastic ring (50) goes back to its unstressed shape, closing the piston skirt's ports (108).

FIG. 3: in this position, an elastic bead (109) placed on the piston skirt arrives opposite the shoulder (121) made at the extremity of the tank (1) body. The radial expansion of said bead under the effect of its elasticity prevents the piston (10) from going backwards. Thus, at the end of the drainage, the piston (10) prevents any gas or fluid from being introduced into the emptied tank.

The above description clearly illustrates that through its various features and their advantages the present invention realizes the objectives it set itself. In particular, it means that a fluid to be ejected can be kept in a tank during the passive phase without deterioration of the sealing means between the body of the tank and the means of ejecting the fluid.

The invention claimed is:

1. A fluid ejection device, comprising:

a cylinder shaped tank, split hermetically, perpendicular to its axis, into two chambers by a piston, which is configured to slide axially inside the tank;

a first chamber, including a non-gaseous fluid, which communicates with an ejection port closed by a cap, which is configured to open for a pressure greater than or equal to a defined pressure in the first chamber; and a second chamber, as a pressurization chamber, configured to be connected to means of increasing pressure in the second chamber;

wherein the piston includes a threaded portion to fix the piston to the tank at a storage position, and includes a breakable portion configured to break and release the piston for axial translation at a pressure higher than or equal to a given pressure in the second chamber, to cause the fluid to be ejected.

2. A device according to claim 1, wherein the breakable portion is configured to break when subjected to a given pressure in the second chamber and cannot be separated whatever the pressure in the first chamber that contains the fluid.

3. A device according to claim 1, wherein the piston comprises means to immobilize the piston in translation in relation to the tank in a direction going from the first chamber towards a second position as a drainage position.

4. A device according to claim 3, wherein:

the piston comprises two areas making a seal with the inner surface of the tank; the areas are separated and arranged axially so as to form an annular chamber between the piston and the inner surface of the tank;

and further comprising:

communication ports between the annular chamber and the second chamber;

means for closing the ports configured to open when subjected to a defined pressure in the second chamber; and means for placing the annular chamber of the piston in communication with the first chamber that contains the fluid when the piston is in a draining axial position.

5. A device according to claim 4, wherein the means for closing the ports includes an elastic ring that expands when subjected to the pressure in the second chamber so as to open the ports.

6. A device according to claim 1, further comprising a cap that closes the chamber comprising the fluid to be ejected and that is detachable at a defined pressure.

7. An aircraft engine nacelle comprising a device according to claim 1.

8. A fluid ejection device, comprising:

a cylinder shaped tank, split hermetically, perpendicular to its axis, into two chambers by a piston, which is configured to slide axially inside the tank;

a first chamber, including a non-gaseous fluid, which communicates with an ejection port closed by a cap, which is configured to open for a pressure greater than or equal to a defined pressure in the first chamber; and a second chamber, as a pressurization chamber, configured to be connected to a gas generator that increases pressure in the second chamber;

wherein the piston includes a threaded portion to fix the piston to the tank at a storage position, and includes a breakable portion configured to break and release the piston for axial translation at a pressure higher than or equal to a given pressure in the second chamber, to cause the fluid to be ejected.

9. A device according to claim 8, wherein the piston includes a bead that prevents movement of the piston in relation to the tank in a direction going from the first chamber towards a second position as a drainage position.

10. A device according to claim 9, wherein:

the piston comprises two areas making a seal with the inner surface of the tank; the areas are separated and arranged axially so as to form an annular chamber between the piston and the inner surface of the tank;

and further comprising:

communication ports between the annular chamber and the second chamber;

a ring configured to open when subjected to a defined pressure in the second chamber; and means for placing the annular chamber of the piston in communication with the first chamber that contains the fluid when the piston is in a draining axial position.

* * * * *